US007658568B1

(12) United States Patent
Armstrong et al.

(10) Patent No.: US 7,658,568 B1
(45) Date of Patent: Feb. 9, 2010

(54) INTERIOR PROTECTANT APPLICATOR

(75) Inventors: Mark Armstrong, Yowie Bay (AU); Anna DiBello, Homebush (AU); Ed Kopinski, Edensor Park (AU); Henri Spaile, Surry Hills (AU); David Petarcic, Hebersham (AU); Wen-Chen Su, Lexington, KY (US)

(73) Assignee: Ashland Licensing and Intellectual Property, LLC, Dublin, OH (US)

( * ) Notice: Subject to any disclaimer, the term of this patent is extended or adjusted under 35 U.S.C. 154(b) by 64 days.

(21) Appl. No.: 11/981,726

(22) Filed: Oct. 31, 2007

Related U.S. Application Data

(60) Provisional application No. 60/855,429, filed on Oct. 31, 2006.

(51) Int. Cl.
*B43K 5/00* (2006.01)

(52) U.S. Cl. ..... 401/206; 401/205

(58) Field of Classification Search ..... 401/202, 401/205, 206, 207, 269, 272, 273, 278
See application file for complete search history.

(56) References Cited

U.S. PATENT DOCUMENTS 3,148,401 A * 9/1964 Gilchrist et al. ..... 401/156
3,484,171 A * 12/1969 Rosendall et al. ..... 401/206
4,993,859 A * 2/1991 Assad et al. ..... 401/206
5,568,990 A * 10/1996 McAuley ..... 401/206

* cited by examiner

*Primary Examiner*—David J Walczak
(74) *Attorney, Agent, or Firm*—Wood, Herron & Evans, L.L.P.

(57) ABSTRACT

An applicator for applying a liquid composition to a work surface. The applicator includes a bottle, a cap detachably mounted on a neck projecting from the bottle and a cover that extends over the cap and an upper portion of the bottle. The cap has and inclined surface with a multi-layer polishing pad mounted thereon. The pad has a cloth outer layer overlying a compressible, preferably foam, under layer. The pad has a central aperture exposing the end of a valve stem. Pressing the pad against the work surface opens a normally closed valve dispensing the liquid in the bottle onto work surface. The valve stem moves reciprocally along a path generally perpendicular an inclined surface on the cap on which the pad is mounted.

4 Claims, 6 Drawing Sheets

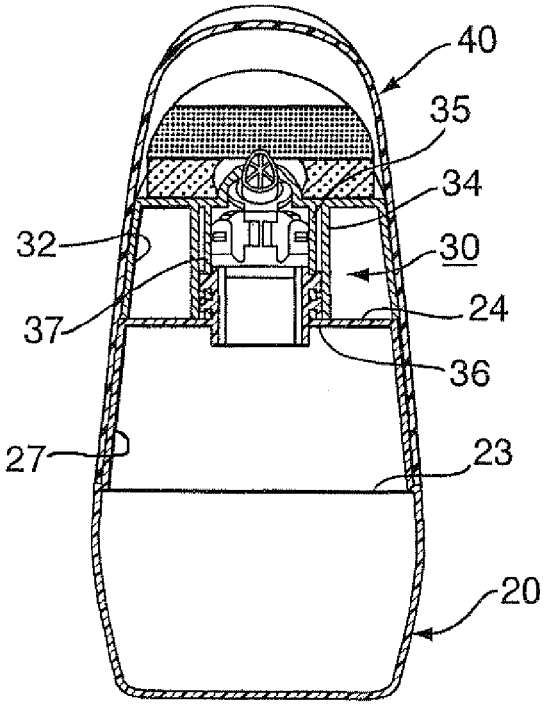
FIG. 3
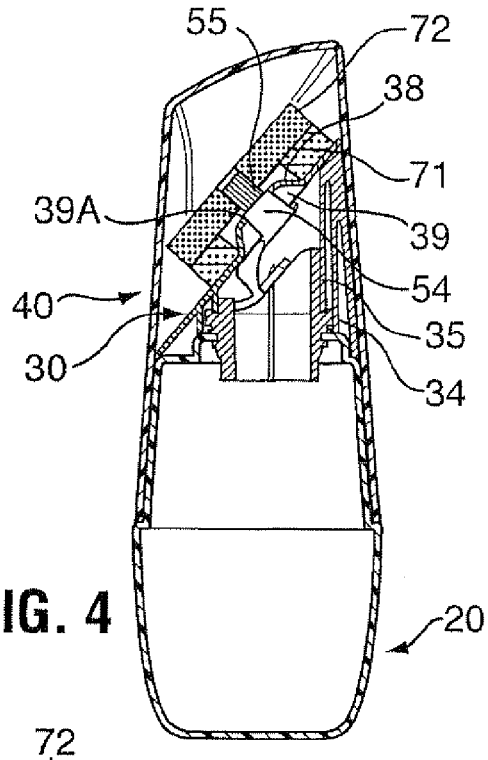
FIG. 4
FIG. 5
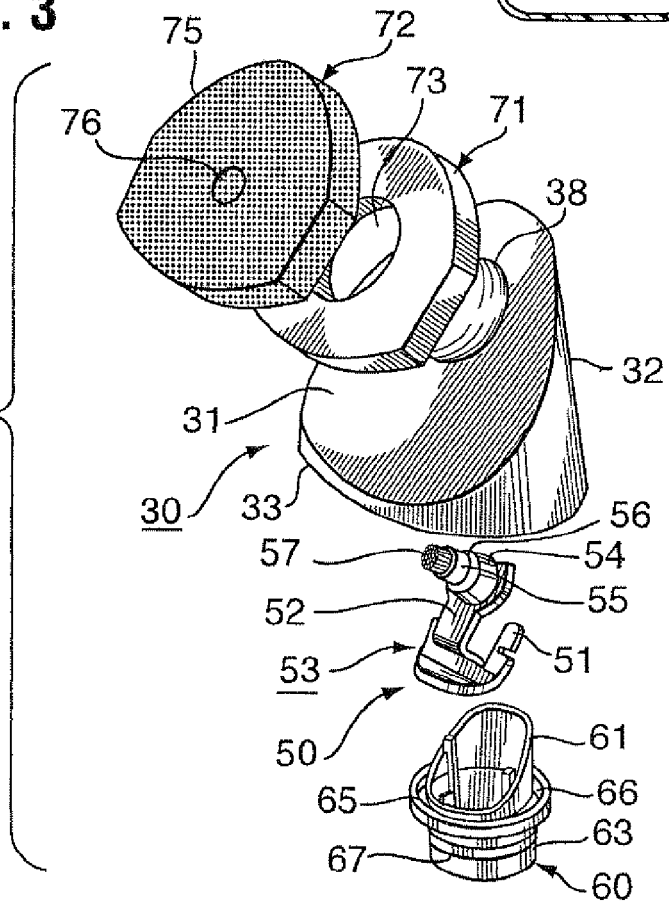

INTERIOR PROTECTANT APPLICATOR

CROSS REFERENCE TO RELATED APPLICATIONS

This application claims priority from U.S. Provisional Application Ser. No. 60/855,429 filed on Oct. 31, 2006 which is incorporated by reference herein in their entirety. Reference to documents made in the specification is intended to result in such patents or literature cited are expressly incorporated herein by reference, including any patents or other literature references cited within such documents as if fully set forth in this specification.

FIELD OF INVENTION

This invention relates generally to applicators and more particularly to an applicator with an improved valve system, to an applicator with an improved applicator pad, and to combinations thereof. The applicator is designed for applying a liquid cleaner and/or polish and/or protectant composition, more particularly a UV protectant composition for application to the dash and other rubber and/or plastic components in the interior of vehicles such as for automobiles, boats and the like but obviously the instant invention may be used for application of other liquids and liquid compositions.

BACKGROUND OF INVENTION

Applicators of the general type to which the present invention relates are numerous and varied many of which have no flow control valve or utilize a manually operative valve and/or have an application pad of a porous foam material.

Obviously no valves give the user little if any control of dispensing liquid from the container during use of the device. Manually operated valves make the devices inconvenient to use and foam pads have not only a short useful life span but are unsuitable for polishing and particularly attaining an evenly applied film of the protectant composition. By way of example of known devices reference maybe had to the following United States Patents: U.S. Pat. No. 6,945,722 issued Sep. 20, 2005 by T. Colburn et al; U.S. Pat. No. 6,592,282 issued on Jul. 15, 2003 by O. Fontanet et al; U.S. Pat. No. 6,425,701 issued on Jul. 30, 2002 by N. Jacobs; U.S. Pat. No. 6,402,413 issued on Jun. 11, 2002 by G. Schwartzman; U.S. Pat. No. 5,299,877 issued on Apr. 5, 1994 by D. Birden; U.S. Pat. No. 5,120,148 issued in Jun. 9, 1992 by W. Waters et al.; U.S. Pat. No. 5,018,894 issued on May 28, 1991 by A. Goncalves; and U.S. Pat. No. 4,201,491 issued on May 6, 1980 by H. Kohler.

SUMMARY OF INVENTION

In an applicator of the present invention the applicator structure includes an applicator pad having a cloth outer layer overlying a compressible (preferably foam) under pad that is secured to the outer face of the container cap. The applicator pad has a central aperture for dispensing liquid from the container onto the surface for application of the cleaner-polish composition. Release of the liquid composition is through a valve that is opened and closed by varying the application of hand pressure when the applicator pad is in contact with the surface to be cleaned and polished during use of the device. The valve is aligned with the aperture in the applicator pad. There is also provided a novel valve assembly that is sealingly engaged and captively retained between the bottle and bottle cap. The cap is press fit (preferably snap interlocking engagement) onto the neck of the bottle. A cover detachably engages the bottle and envelopes the container cap improving the shelf life of the applicator

BRIEF DESCRIPTION OF THE DRAWINGS

A better understanding of the present invention will be had upon reference to the following description in conjunction with the accompanying drawings in which like numerals refer to like parts throughout the several views and wherein:

FIG. 3 is a sectional view taken along line 3-3 of FIG. 1;

FIG. 4 is a sectional view taken along line 4-4 of FIG. 1;

FIG. 5 is and exploded view of the cap and valve assembly portion of the applicator;

DESCRIPTION OF PREFERRED EMBODIMENT

Figure 1:
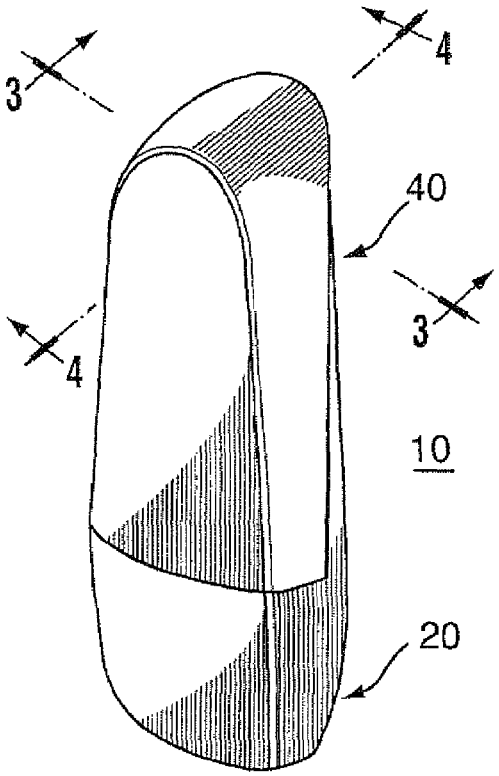
FIG. 1 is an oblique view of an applicator of the present invention.
Figure 2:
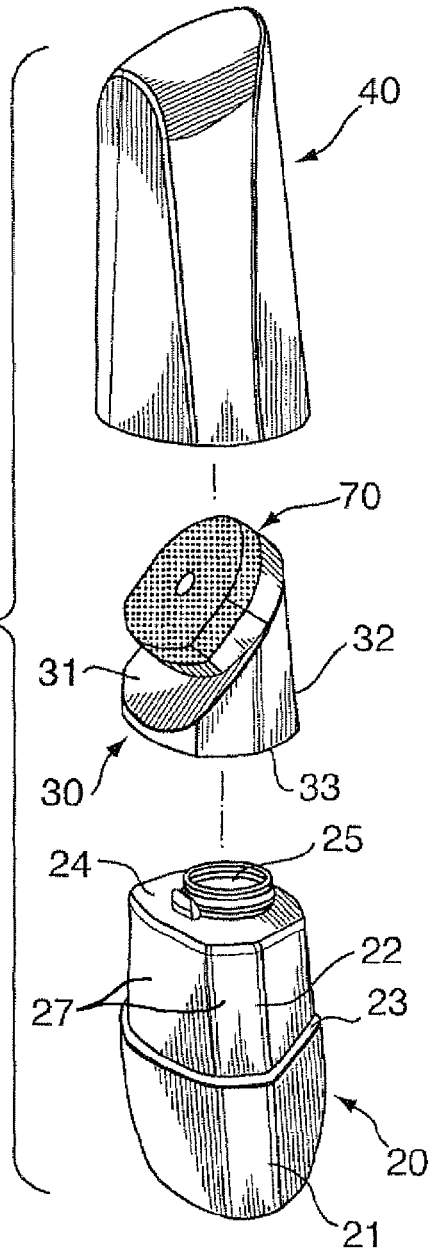
FIG. 2 is an exploded view of the applicator shown in FIG. 1.

Illustrated in FIGS. 1 to 5 is an applicator 10 comprising a bottle 20, (sometimes hereinafter referred to as container), a bottle cap 30 and a bottle cap cover 40. Mounted on the bottle 20, and captively retained between the bottle 20 and the bottle cap 30, is a valve assembly 50. A multilayer applicator pad 70 is mounted on an angled outer face 31 of the bottle cap 30. The surfaces of the bottle 20, cap 30 and cover 40 are multi-faceted complimenting one another for appearance and inter-fitting in inter-nested relation with some of the faces being generally flat while others are curved.

The bottle 20 has a multi-faceted upper and lower portions 22, 21 with the upper portion 22 being of smaller size and thereby providing a peripheral ledge 23 proximate mid height of the bottle 20. The upper portion 22 tapers inwardly in a direction upwardly and the lower portion 21 curves inwardly in a direction downwardly terminating in a bottom flat wall defining a narrow lip or edge on which the container can sit during non-use. The bottle 20 has a flat top end wall 24 with an open ended neck 25 projecting radially therefrom. The ledge 23 preferably has a width proximate the thickness of the lower portion of the cover 40 so as to provide a generally smooth outer surface. For aesthetic purposes the cover 40 and the bottle 20 can be of contrasting colors and/or of similar or differing materials with the bottle preferably being darker in color than the cover 40.

the lower portion of the cover 40 is preferably in close or tight fit relation on the bottle 20 and this is facilitated by a taper of the inter-engaging walls 27 located on the upper portion 22. Recesses and projections maybe provided to provide detachable inter-engagement.

The bottle cap 30 has an outer peripheral wall 32 extending downwardly from the sloped top face 31 and terminates in a lower edge 33 that abuts against the top end wall 24 of the bottle 20. The outer face of the wall 32 is multi-faceted matching as a continuation of the tapered upper portion 22 of the bottle. A pair of concentric respective outer and inner annular walls 34, 35 project downwardly from the top end of the cap 30 and terminate in respective lower ends 36, 37 that are offset from one another. The upper wall of the cap 30 has an outwardly projecting bulbous portion 38 providing on the underside thereof a cavity 39. The bulbous portion 38 includes an aperture 39A centrally disposed therein through which liquid in the container 20 is dispensed by inverting the applicator 10 and pressing the applicator pad 70 against the surface to which the liquid composition is to be applied as will become more apparent hereinafter.

The valve assembly 50 as best illustrated in FIG. 5 includes a valve body 53 having a horse-shoe like base 51 with a resiliently flexible arm 52 canter-levered therefrom. A valve stem 57 is mounted on the arm 52 at a position proximate a free outer end of the arm 52 and projects therefrom in axial alignment with the hole 39A in the cap 30. The valve stem 57 has respective first and second portions 54, 55 with the latter being smaller in outline size providing a ledge 56 at the intersections of such portions. The first portion 54 is larger in outline size than the through hole 39A in the bottle cap 30 while the second portion 55 is smaller so as to project there through with the distance of projection being less than and co-related to the thickness of the applicator pad 70 and compensability of a pad resilient layer 71. The ledge 56 (frusto-conical in shape) and the rim of the hole 39A provides a flow control valve for selectively releasing liquid from the container in alignment with the hole in the applicator pad 70.

The base 51 of the valve body 53 rests on a sloped end 61 of a spigot 60 that has a portion 63 thereof that projects in an open ended neck 25 of the bottle 20. Intermediate opposite ends of the spigot 60 there is an outer circumferential rib 65 that abuts against the outer end of the bottle neck 25 and has a portion 66 that projects into the space between the cap annular walls 34, 35. The portion of the spigot 60 that projects into the bottle neck 25 has one or more circumferential ribs 67 to ensure a liquid seal preventing leakage of the liquid from the bottle 20 when the latter is inverted and evaporation during non-use.

Mounted on the angled outer face 31 of the bottle cap is a multi-layer applicator pad 70 comprising respective inner and outer layers 71, 72. The layer 71 is made of a compressible material such as a relatively soft foamed material and has a central through hole 73. The bulbous portion 38 on the sloped face 31 projects into this hole. The layer 71 is attached to the cap in any convenient manner as for example by a suitable adhesive or friction fit.

The layer 72 has at least the outer face 75 thereof made of a soft fabric (preferably woven) and has a central through hole 76 disposed in axial alignment with the hole 39A in the container cap 30. The layer 72 maybe securely attached to the layer 71 or alternatively attached as for example by a sticky adhesive permitting removing a used layer and substituting therefor a new one from time to time as determined maybe needed for a high gloss shine.

Illustrated in FIGS. 6-9 are various modifications that include modified bottle caps, modified valve assemblies, mounting of the valve assemblies on the bottle cap and various means of sealing engagement of the bottle and bottle cap.

Figure 6:
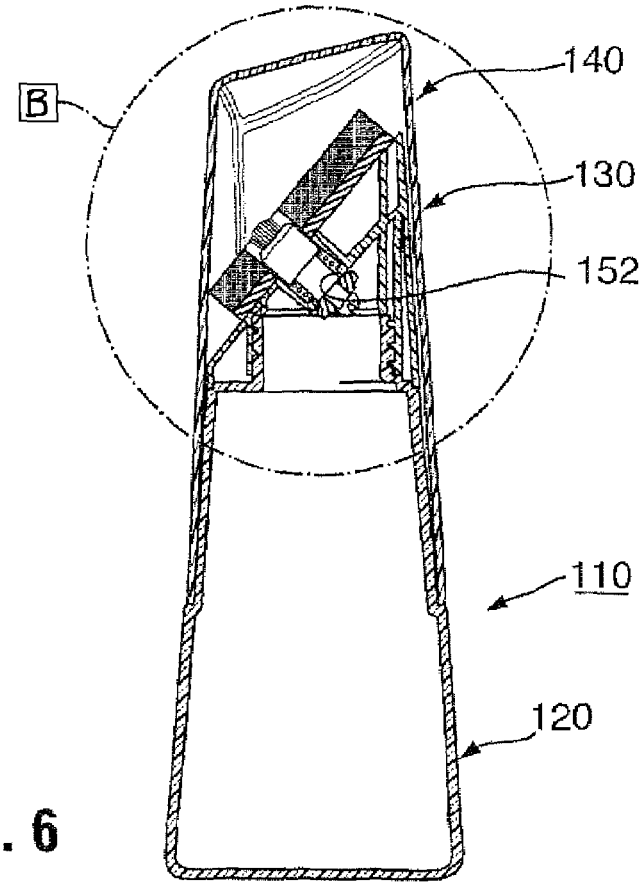
FIG. 6 is a sectional view shows a valve assembly mounted on a bottle cap including a first valve assembly.
Figure 7:
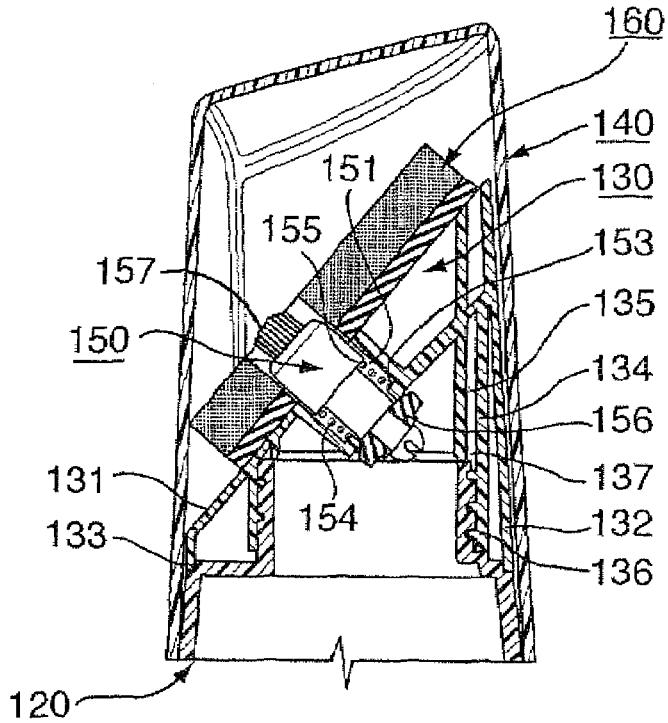
FIG. 7 shows the valve assembly of FIG. 6, wherein the portion B is encircled in FIG. 6 but on a larger scale.
Figure 8:
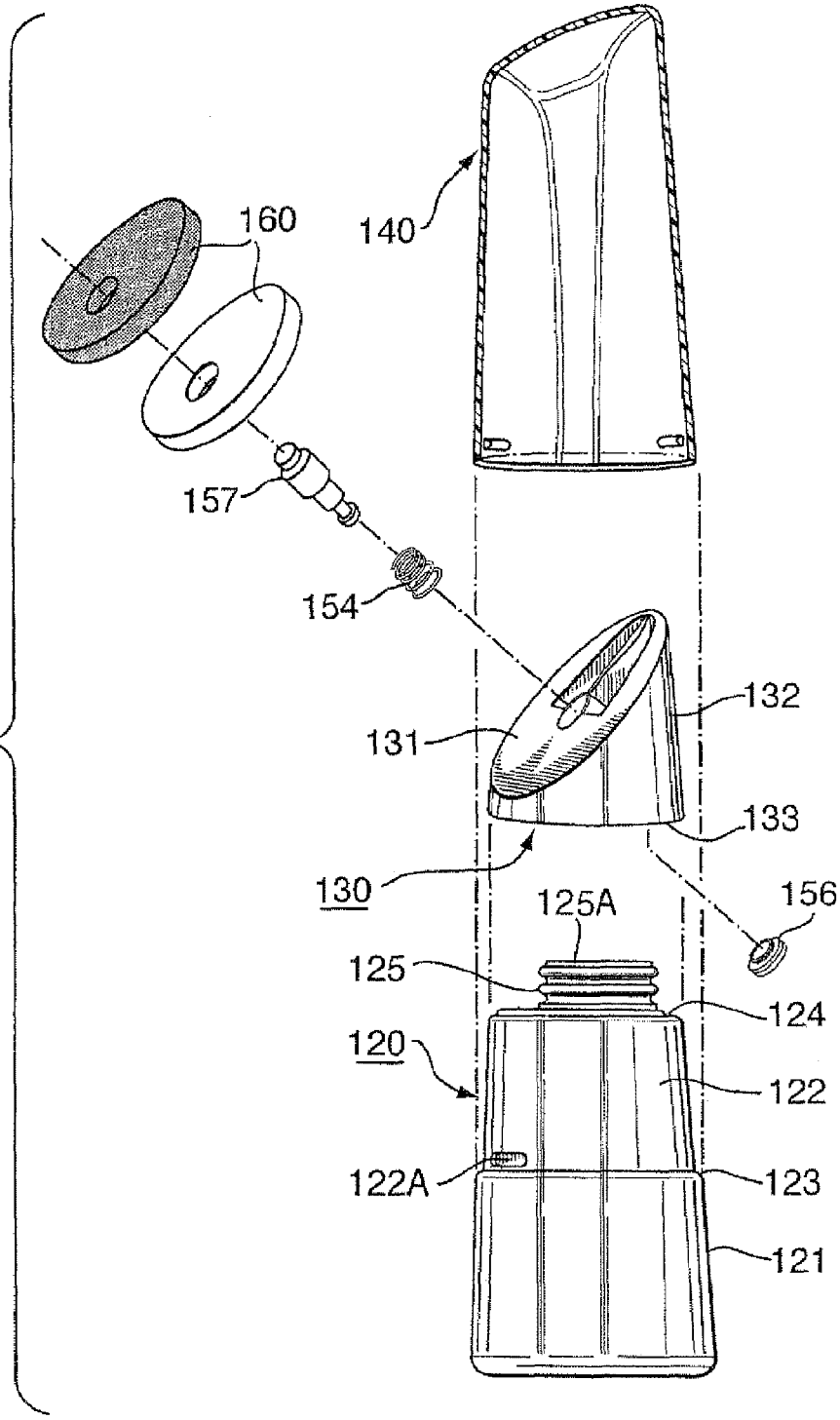
FIG. 8 is an exploded view of the valve assembly of FIG. 6 illustrating the various components of the applicator.

Referring to FIGS. 6-8 there is illustrated an applicator 110 comprising a bottle 120, a bottle cap 130 and a bottle cap cover 140. Mounted on the bottle cap 130 is a valve assembly 150 and a multilayer applicator pad 160. As before the surfaces of the bottle, cap and cover are multifaceted complimenting one another for appearance and inter-fitting in inter-nested relation with some of the faces being generally flat while others are curved.

The bottle 120 has respective lower and upper portions 121, 122 with the latter being of reduced size providing a peripheral ledge 123 proximate mid height of the bottle. The upper portion 122 tapers inwardly in a direction upwardly and has two or more circumferentially spaced apart indentations 122A. The lower portion curves inwardly in a direction downwardly and terminates at a bottom flat wall on which the container can sit during non-use. The bottle 120 has a flat upper end 124 with an open ended neck 125 projecting upwardly therefrom. The neck opening is in fluid flow communication with an inner cavity in the bottle 120 which is capable of holding a selected quantity of a solution to be dispensed from the applicator 110. The ledge 123 preferably has a width proximate the thickness of the lower portion of the cover 140 so as to provide a generally smooth outer surface. For aesthetic purposes the cover 140 and bottle 120 preferably are of contrasting colors.

The bottle cap 130 has an outer peripheral wall 132 extending downwardly from the sloped top face 131 terminating in lower edge 133 that abuts against the top end wall 124 of the bottle 120. The outer face of the wall 132 is multi-faceted matching as a continuation the tapered upper portion 122 of the bottle. A pair of concentric respective outer and inner annular walls 134, 135 project downwardly from the top end of the cap and terminate in respective lower ends 136, 137 that are offset from one another. The lower portion of wall 134 (extending beyond the lower end 137 of wall 135) press fits onto the neck 125 and has depressions therein receiving protrusions on the neck. Alternate ribs and grooves on each of the mating surfaces provides a snap inter-locking fit.

The lower edge 137 of the inner wall 135 is pressed in fluid seal tight relation against the upper edge 125A of the neck (or a gasket (compressible preferred) mounted thereon).

The solution, liquid or liquid composition in the bottle is dispensed by inverting the bottle and pressing the applicator pad 160 against a surface onto which such solution is to be applied. Such action opens the normally closed valve 150 for fluid flow there through.

The valve 150 includes a valve stem 157 mounted for reciprocal movement along the longitudinal axis of a cylindrical recess 151 extend into the area circumscribed by the inner wall 135 from the inclined outer surface 131 of the bottle cap. The longitudinal axis of the recess is perpendicular to the inclined surface thereby normally avoiding lateral forces being applied to the valve stem 157. The recess 151 has a bottom wall with a through hole 152 smaller in diameter than the recess thus providing a ledge 153 that acts as an abutment for a compression spring 154. The other end of the compression spring abuts against a shoulder 155 on the valve stem. The valve stem 157 extends through the spring, on through the hole 152 and carries proximate the end thereof an o-ring valve element or valve seal 156. The spring biases the valve element seal to a valve normally closed at rest position.

Figure 9:
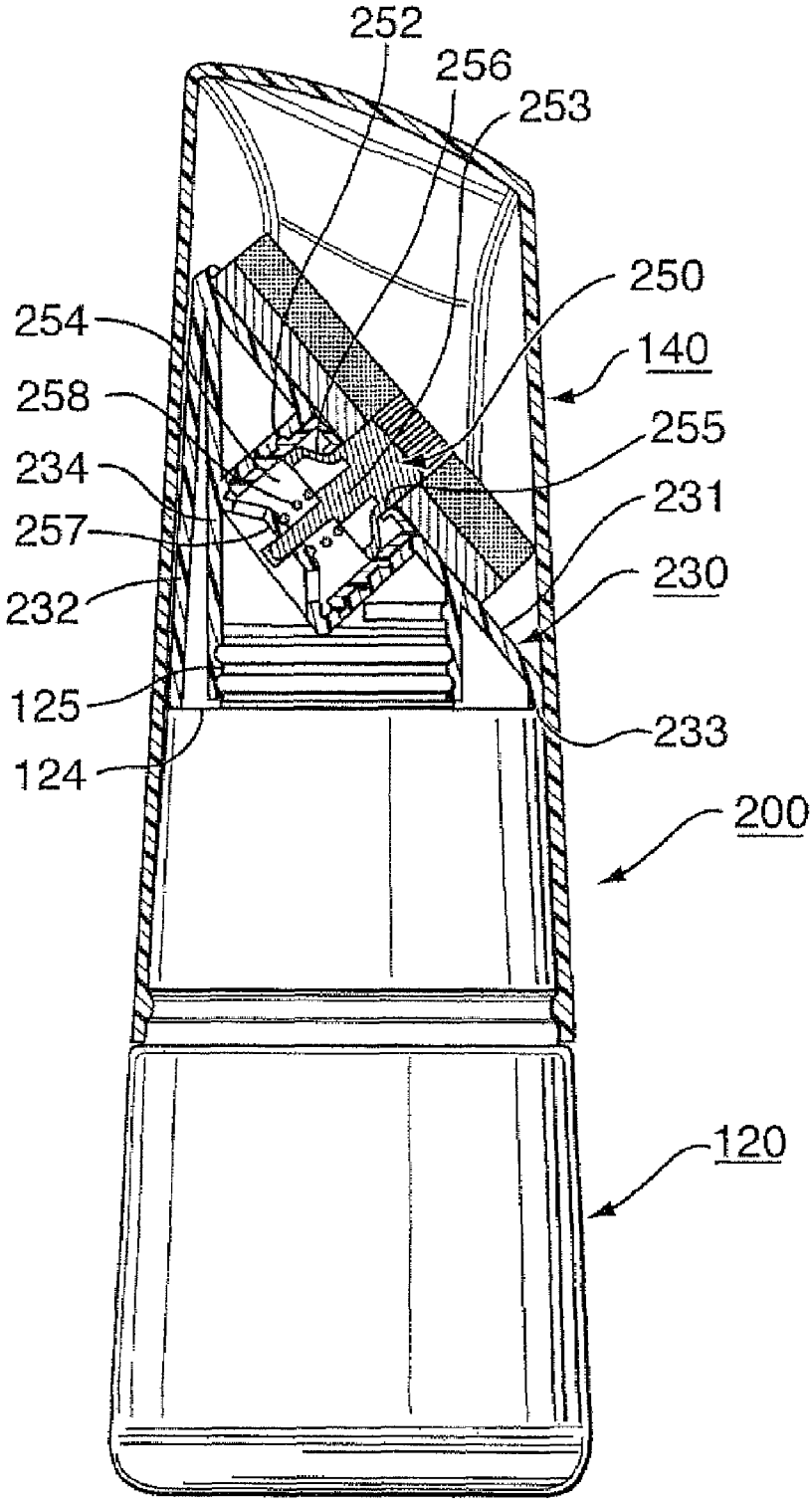
FIG. 9 is a sectional view of the valve assembly of FIG. 6, illustrating alternate valve assembly and modifications to the cap.

In FIG. 9 there is illustrated an applicator 200 comprising a bottle 120 and cover 140 as previously described and a modified bottle cap 230. The bottle cap 230 has an outer peripheral wall 232 extending downwardly from a sloped top face 231 and terminates in a lower edge 233 that abuts against the top wall 124 of the bottle 120. The outer face is multifaceted matching as a continuation the tapered upper portion of the bottle. An annular wall 234 projects downwardly from the top end of the cap and is spaced inwardly from and circumscribed by the outer wall 232. The wall 234 has a lower end portion that fits over and press fits onto the neck 125 of the bottle. Alternate annular ribs and grooves on each of the inner surface of the wall 234 and outer face of the bottle neck provides a snap fit interlocking engagement of the bottle 120 and bottle cap 230.

The bottle cover 230 has a valve assembly 250 mounted thereon that includes a valve body member 252 with a valve stem 253 reciprocally mounted therein. The valve body 252 is a sleeve like member with an outer ribbed surface that press fits into a recess 254 in the sloped top wall 231 of the cover and has at an outer end thereof an end wall with a through hole 255. The stem 253 carries therewith an outwardly flared frusto-conical valve element 256 that is sealingly engagable with the peripheral edge of the through hole 255 (or separate valve seat thereon if so desired) on the valve body 252. The stem 253 has an outer end portion that projects partially through a hole in the applicator pad 270 and at the opposite end there is a portion that is reciprocally movable in a through hole in a hub and spoke member 257 at the bottom of the recess 254. A metal compression spring 258 has opposite ends thereof engaging respectively the member 257 and a shoulder on the valve stem biasing the valve to an at rest normally closed position. The spokes of the hub and spoke member 257 permits free flow of liquid from the container 220 into the valve body 252 when the applicator 210 is inverted and dispensing therefrom is as described hereinbefore by pressing the applicator pad 270 against the surface to which the liquid composition in the bottle 220 is to be applied.

Figure 10:
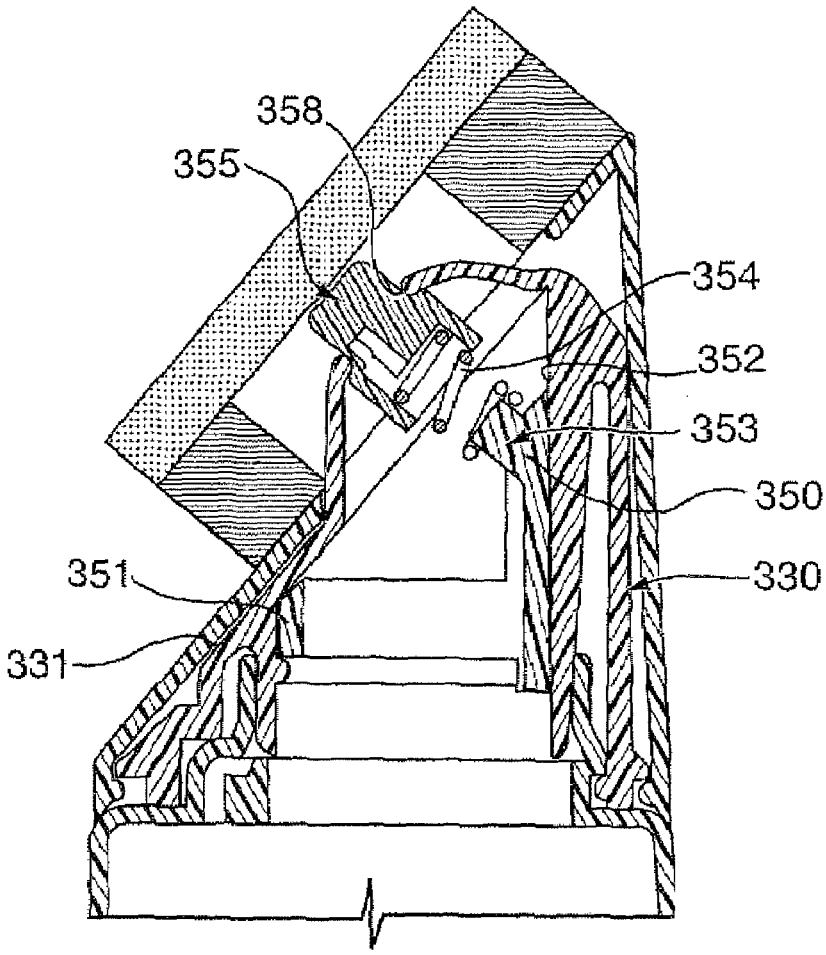
FIG. 10 is sectional view of another embodiment of the valve assembly.
Figure 11:
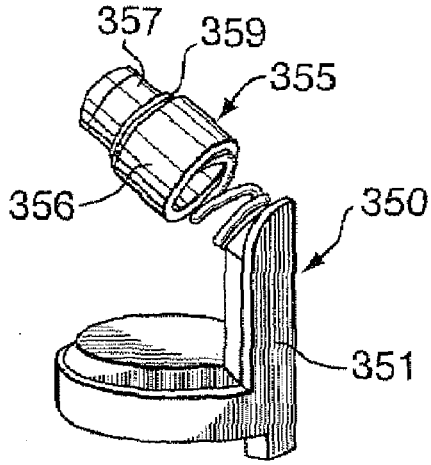
FIG. 11 is an oblique view of the valve element in the valve assembly shown in FIG. 10.

A cover 330 is illustrated in FIG. 10 and mounted therein is a valve assembly 350. The assembly 350 includes a base member 351 that slip fits into a cylindrical recess 352 disposed on the under side of the inclined top end wall 331. The base can be locked in position by one or more protrusions extending into the recess 352 or by for example a c-clip.

The base 351 has a post 353 that projects into one end of a compression spring 354 the opposite end of which projects into a recess in the end of a valve member 355. The member 355 has respective first and second contiguous sections 356, 357 with the latter being smaller in diameter. The section 357 projects through a through hole 358 in a bulbous portion in the wall 331. A shoulder 359 at the juncture of sections 356 and 357 is biased by the spring into engagement with the periphery of the hole 358 providing a valve normally closed position. At least one of the valve seat and shoulder 359 can if desired maybe provided with an o-ring seal.

In the foregoing embodiments the bottle neck provides an elongate fluid flow passage. The cap face on which the applicator pad is mounted is inclined at a selected angle relative to such passage. The angle is chosen to facilitate reaching hard to get at places such as for example a vehicle dashboard at the juncture of the same and the vehicle windshield. The cap has a fluid flow passage and reciprocal movement of the valve stem (valve actuator portion) is along a path generally perpendicular to the slope bottle cap face. The metal spring allows the manufacturer to choose a spring force suited to characteristics of the liquid that will be used in the device; however it is contemplated that a living spring comprising a polymer with memory could also be used as a spring means.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented herein above. Rather, what is intended to be covered is within the spirit and scope of the appended claims.

We claim:

1. An applicator for applying a liquid composition to a work surface, said applicator comprising:

a container having and an open outer end, said cavity being capable of holding a selected quantity of said liquid composition;

a cap detachably mounted on said container and having an outer face, said cap having a fluid flow passage there through communicating with said cavity and terminating in an opening in said cap, said outer face having an inner ledge disposed around the opening;

a valve assembly disposed in said fluid flow passage through said cap, said valve assembly including a valve stem reciprocally movable along a path generally perpendicular to said face and including a portion projecting a selected distance through said opening in said outer face, said valve stem having a shoulder and a valve seal adapted to seat against an inner surface of said fluid flow passage;

a spring between said shoulder of said valve stem and said ledge of said outer face adapted to urge said valve seal to seat against said inner surface of said fluid flow passage; and a resiliently compressible polishing pad mounted on said outer face wherein said cap outer face has a central bulbous portion projecting in to said polishing pad.

2. The applicator as defined in claim 1, wherein said container includes an open ended neck projecting from said container and wherein said cap is mounted on said open ended neck.

3. The applicator as defined in claim 1, wherein said cap outer face is planar.

4. An applicator for applying a liquid composition to a work surface, said applicator comprising:

a container having an open ended neck in fluid flow communication with a cavity in the container, said cavity being capable of holding a selected quantity of said liquid composition;

a cap mounted on said container neck and having a outer face inclined at selected angle with respect to said container neck, said cap having a fluid flow passage there through communicating with said container neck and terminating in an opening in said cap inclined outer face, said outer face including an inwardly extended ledge portion disposed around the opening;

a valve assembly disposed in said fluid flow passage through said cap, said valve assembly including a valve stem reciprocally movable along a selected path relative to said inclined face and including a portion projecting a selected distance through said opening in said outer face, said valve stem having a shoulder and valve seal adapted to seat against an inner surface of said fluid flow passage;

a spring between said shoulder of said valve stem and said ledge portion of said outer face adapted to urge said valve seal to seat against said inner surface of said fluid flow passage;

a resiliently compressible polishing pad mounted on said outer face wherein said cap outer face has a central bulbous portion projecting in to said polishing pad; and a cover receiving therein said cap and an upper portion of said container.

* * * * *

UNITED STATES PATENT AND TRADEMARK OFFICE

CERTIFICATE OF CORRECTION

PATENT NO. : 7,658,568 B1
APPLICATION NO. : 11/981726
DATED : February 9, 2010
INVENTOR(S) : Mark Armstrong et al.

It is certified that error appears in the above-identified patent and that said Letters Patent is hereby corrected as shown below:

Col. 3, line 16, "canter-levered therefrom." should read --cantilevered therefrom.--

Col. 5, lines 44-45, "can if desired maybe provided with" should read --can if desired be provided with--

Col. 6, line 7, claim 1, "having and an open outer end," should read --having an open outer end,--

Signed and Sealed this

Eighth Day of June, 2010

David J. Kappos

David J. Kappos
*Director of the United States Patent and Trademark Office*